US008480464B2

(12) United States Patent
Fujimoto et al.

(10) Patent No.: US 8,480,464 B2
(45) Date of Patent: Jul. 9, 2013

(54) PUZZLE PLANE GENERATION SYSTEM AND METHOD FOR GENERATING PUZZLE PLANE

(75) Inventors: Eisaku Fujimoto, Tokyo (JP); Tomotake Haruta, Tokyo (JP)

(73) Assignee: Konami Digital Entertainment Co., Ltd., Tokyo (JP)

( * ) Notice: Subject to any disclaimer, the term of this patent is extended or adjusted under 35 U.S.C. 154(b) by 197 days.

(21) Appl. No.: 12/744,219

(22) PCT Filed: Dec. 16, 2008

(86) PCT No.: PCT/JP2008/072875

§ 371 (c)(1),
(2), (4) Date: Dec. 15, 2010

(87) PCT Pub. No.: WO2009/110155

PCT Pub. Date: Sep. 11, 2009

(65) Prior Publication Data

US 2011/0101608 A1 May 5, 2011

(30) Foreign Application Priority Data

Mar. 7, 2008 (JP) ..... 2008-058369

(51) Int. Cl.
*A63F 9/00* (2006.01)

(52) U.S. Cl.
USPC ..... 463/9

(58) Field of Classification Search
USPC ..... 463/9; 273/157 R
See application file for complete search history.

(56) References Cited

U.S. PATENT DOCUMENTS

| | | | | |
|---|---|---|---|---|
| 5,605,332 | A | 2/1997 | Harnett | |
| 2002/0183112 | A1* | 12/2002 | Emmerson et al. | 463/41 |
| 2006/0073863 | A1* | 4/2006 | Hagiwara | 463/9 |
| 2007/0287517 | A1 | 12/2007 | Asuna et al. | |
| 2008/0182664 | A1* | 7/2008 | Kaplan et al. | 463/42 |

FOREIGN PATENT DOCUMENTS

| | | | |
|---|---|---|---|
| EP | 1859845 | A1 | 11/2007 |
| JP | 03-166653 | | 7/1991 |
| JP | 5-135055 | | 6/1993 |
| JP | 06-142304 | A | 5/1994 |
| JP | 06-142340 | | 5/1994 |

(Continued)

OTHER PUBLICATIONS

EP Search Report for App No. EP08873044 dated Jan. 13, 2012.

*Primary Examiner* — David L Lewis
*Assistant Examiner* — Shauna-Kay Hall
(74) *Attorney, Agent, or Firm* — Edwards Wildman Palmer LLP; Brian R. Landry

(57) ABSTRACT

A puzzle plane generation system generates a puzzle plane constituted by plural cells. Puzzle plane information defines, for each of a matrix of cells constituting a puzzle plane, position coordinates and line type information where line types of the two sides crossing at a predetermined corner are connected to each other. A line information generation unit and a puzzle plane information generation unit are provided. The line information generation unit connects each of the two sides constituting the line type information of each cell in a new puzzle plane and a side of the puzzle plane, and generates line type information by determining each line type of each side of the line type information of the cell of the new puzzle plane as the line type of side of the puzzle plane connected to each of the sides by referring to the puzzle plane information.

6 Claims, 18 Drawing Sheets

FOREIGN PATENT DOCUMENTS

| | | | |
|---|---|---|---|
| JP | 08-309021 | | 11/1996 |
| JP | 2001-246152 | A | 9/2001 |
| JP | 2006-262994 | A | 10/2006 |
| JP | 2006-304816 | | 11/2006 |

* cited by examiner

FIG. 7

CONVERSION TYPE 1. 90—DEGREE ROTATION 2. 180—DEGREE ROTATION
(90—DEGREE ROTATION × 2TIMES)

3. 270—DEGREE ROTATION
(90—DEGREE ROTATION × 3TIMES)

4. UP—AND—DOWN INVERSION

5. UP—AND—DOWN INVERSION
+90—DEGREE ROTATION

6. UP—AND—DOWN INVERSION
+180—DEGREE ROTATION
(90—DEGREE ROTATION × 2TIMES)

7. UP—AND—DOWN INVERSION
+270—DEGREE ROTATION
(90—DEGREE ROTATION × 3TIMES)

FIG. 9

T

| | PROCESS CELL | REFERENCE CELL | ADJACENT CELL | ADJACENT REFERENCE CELL | LINE TYPE INFO. |
|---|---|---|---|---|---|
| 90-DEGREE ROTATION | (X, Y) | (Y, −X) | (X, Y+1) | (Y+1, −X) | (p, q) |
| UP-AND-DOWN INVERSION | (X, Y) | (X, −Y) | (X, Y+1) | (X, −Y−1) | (o, r) |

FIG. 13A

MT1

| PROCESS CELL | REFERENCE CELL | ADJACENT REFERENCE CELL |
|---|---|---|
| M1' | M3 | |
| M2' | M6 | |
| M3' | M9 | |
| M4' | M2 | M3 |
| M5' | M5 | M6 |
| M6' | M8 | M9 |
| M7' | M1 | M2 |
| M8' | M4 | M5 |
| M9' | M7 | M8 |

FIG. 13B

MT2

| PROCESS CELL | REFERENCE CELL | ADJACENT REFERENCE CELL |
|---|---|---|
| M1' | M7 | |
| M2' | M8 | |
| M3' | M9 | |
| M4' | M4 | M7 |
| M5' | M5 | M8 |
| M6' | M6 | M9 |
| M7' | M1 | M4 |
| M8' | M2 | M5 |
| M9' | M3 | M6 |

FIG. 13C

MT3

| REFERENCE CELL | ADJACEMT REFERENCE CELL | PROCESS CELL |
|---|---|---|
| P1 | P1 | P1 |
| P1 | P2 | P1 |
| P1 | P3 | P2 |
| P1 | P4 | P2 |
| P2 | P2 | P3 |
| P2 | P3 | P4 |
| P2 | P4 | P4 |
| P3 | P3 | P2 |
| P3 | P4 | P2 |
| P4 | P4 | P4 |

FIG. 15B

140

SOH>H1H2 > H3 >H5 H4>EOH 141 142 143 144 145

FIG. 15C

150

SOA>431>324>213>EOA 151 152 153 154 155

PUZZLE PLANE GENERATION SYSTEM AND METHOD FOR GENERATING PUZZLE PLANE

TECHNICAL FIELD

The present invention relates to a puzzle plane generation system and method for generating a puzzle plane for generating a puzzle plane constituted by a plurality of cells.

BACKGROUND ART

A puzzle game such that a puzzle plane constituted by a plurality of cells is presented as a puzzle question and a user is allowed to input information to at least a part of the cells so as to satisfy a predetermined condition, has been already known (refer to, for example, Patent Document 1).

Patent document 1: Japanese Patent Application Publication Laid-Open No. 3-166653

DISCLOSURE OF THE INVENTION

Problem to be Solved by the Invention

However, in the case of generating a puzzle plane for use in such a puzzle game, to make a puzzle question, it has to be noted that at least a part of the cells satisfies the predetermined condition. Consequently, when there are not a few conditions associated with a puzzle plane, it needs to take a long time to generate the puzzle plane. In particular, it is difficult to generate a number of puzzle planes in a short time.

An object of the present invention is therefore to provide a puzzle plane generation system and a method for generating puzzle plane for easily generating a puzzle plane constituted by a plurality of cells in a short time.

Means for Solving Problem

The present invention solves the above-described problem by the following means.

A puzzle plane generation system according to the present invention solves the above problems by being configured as a puzzle plane generation system for generating a puzzle plane for a puzzle game in which a plurality of rectangular cells are presented, the rectangular cells being arranged in a matrix, a part of sides of the plurality of cells are represented by a first line type, and sides other than the part of sides are represented by a second line type, and a user is requested input to the plurality of cells so as to satisfy a predetermined condition according to a line type, the puzzle plane generation system comprising: a storage unit for storing, with respect to each of the cells in the puzzle plane, puzzle plane information including position coordinates of each of the cells and line type information in which the line types of two sides crossing at a predetermined apex are associated with each other; and a new puzzle plane generation unit for generating a new puzzle plane by geometrically converting the puzzle plane, wherein the new puzzle plane generation unit comprises: a line type information generation unit for generating the line type information by associating each of the two sides relating to the line type information of each of the cells in the new puzzle plane with a side in the puzzle plane to be converted to the side of the new puzzle plane and determining a line type of each of the two sides relating to the line type information of each cell in the new puzzle plane as a line type of a side of the puzzle plane corresponding to the side of the new puzzle plane with reference to the puzzle plane information; and a puzzle plane information generation unit for generating puzzle plane information of the new puzzle plane by associating the position coordinates of each cell in the new puzzle plane with the line type information of the cell generated by the line type information generation unit.

The puzzle plane generation system of the present invention is a system for generating a puzzle plane using two kinds of line types and providing a puzzle based on the line types. The new puzzle plane generation unit geometrically converts one puzzle plane having the first line type and the second line type, thereby a new puzzle plane can be generated. The construction of the puzzle plane is determined by puzzle plane information including the position coordinates and the line types of two sides crossing at a predetermined apex for each cell. In the case where the predetermined apex is an apex at a position of the top left, for example, the line types of a top side and a left side are associated with each cell. The new puzzle plane generation unit comprises a line type information generation unit and a puzzle plane information generation unit. The line type information generation unit determines a line type for each side in a new puzzle plane based on a line type of a pre-conversion side of the side, and the puzzle plane information generation unit sets information about each cell in the new puzzle plane. Thereby, the new puzzle plane is generated. The geometric conversion includes a rotation, up-and-down inversion and the like. Each of the sides constituting a puzzle plane is converted by a same way of conversion as each other. Consequently, it is easy to specify a side to be a pre-conversion side for each side in a new puzzle plane. Additionally, only the position and the line types of two lines are required as the information for specifying each cell. Thereby, it is possible to reduce the load of the new puzzle plane generation unit and save memory in the storage unit.

Any line types may be used as long as the first and second line types can be visually distinguished from each other. It includes the case where forms of the lines are different from each other such as a dotted line and a heavy line, and the case where the colors of the lines are different from each other. As the coordinate system for obtaining the position coordinates, any coordinate system may be employed as long as the position of each cell can be specified two-dimensionally such as a coordinate system using the center of a puzzle plane as an origin, or a coordinate system using one of apexes of a puzzle plane as an origin. The mode of presenting a puzzle plane includes the case of electrically displaying the puzzle plane on a game screen, and the case of printing and presenting a puzzle plane on a recording member such as paper or a film.

The puzzle plane may include a surrounded part in which at least one cell is surrounded by the first line type, a side of each cell constituting the surrounding line is represented by the first line type, and a side of each cell which is not constituting the surrounding line is represented by the second line type. With this arrangement, the present invention can be adapted to a puzzle which gives a predetermined condition to at least one cell included in the surrounded part.

An outer frame of the puzzle plane may be represented by the first line type. In the present invention, the line type information is information indicative of line types of two sides crossing at a predetermined apex of a cell. Consequently, there is a case that the line type of a side corresponding to the outer frame of the puzzle plane cannot be obtained from the line type information. In this case, it is sufficient to process the line type as the first line type. Therefore, information related to the line type of the outer frame is unnecessary.

The cell may have a square shape, a same number of cells may be arranged in a vertical direction and a horizontal direction, and the geometrical conversion may be any one of 90-degree clockwise rotation, 90-degree counterclockwise rotation, right-and-left inversion, or up-and-down inversion. In the case of such a puzzle plane, without changing the form of the entire puzzle plane, a new puzzle plane can be generated by 90-degree rotation or up-and-down inversion. The "inversion" refers to a conversion of inverting a plurality of cells positioned on the right and left sides or upper and lower sides with respect to the symmetry line in the horizontal or vertical direction passing through the center of the puzzle plane.

The line type information generation unit may comprises: a reference cell determining portion for setting each cell in the new puzzle plane as a process cell in predetermined order, and determining as a reference cell, a cell in the puzzle plane to be converted to the process cell; an adjacent reference cell determining portion for determining an adjacent cell sharing a side which is any one of the two sides relating to the line type information of the process cell, and does not correspond to the two sides relating to the line type information of the reference cell, and determining as an adjacent reference cell, a cell in the puzzle plane to be converted to the adjacent cell; an adjacent reference cell line type obtaining portion for obtaining the line type information of the adjacent reference cell with reference to the puzzle plane information; an adjacent line type determining portion for determining the line type of a side corresponding to the sharing side in the adjacent cell, with reference to the obtained line type information; and a process cell line type determining portion for determining the line type information of the process cell by associating, to a side corresponding to any one of the two sides relating to the line type information of the reference cell out of the two sides relating to the line type information of the process cell, the line type of the corresponding side, and, associating to a side not corresponding to either of the two sides relating to the line type information of the reference cell, the line type determined by the adjacent line type determining portion, and the puzzle plane information generation unit may generate the puzzle plane information of the new puzzle plane by associating the position coordinates of the process cell in the new puzzle plane with the line type information generated by the line type information generation unit.

In this case, since the relative relations between each of the reference cell, the adjacent cell, and the adjacent reference cell and the process cell are constant, when the relative relations are preliminarily determined, only by sequentially determining a process cell, the line type information appropriate to the position of the process cell can be immediately obtained.

A puzzle plane generation method according to the present invention solves the above problems by being configured as a puzzle plane generation method for generating a puzzle plane for a puzzle game in which a plurality of rectangular cells are presented, the rectangular cells being arranged in a matrix, a part of sides of the plurality of cells are represented by a first line type, and other sides than the part of sides are represented by a second line type, and a user is requested input to the plurality of cells so as to satisfy a predetermined condition according to a line type, the puzzle plane generation method including: a step storing, with respect to each of the cells in the puzzle plane, puzzle plane information including position coordinates of each of the cells and line type information in which the line types of two sides crossing at a predetermined apex are associated with each other; and a step of generating a new puzzle plane by geometrically converting the puzzle plane, wherein the step of generating the new puzzle plane including: a step of generating the line type information by associating each of the two sides relating to the line type information of each of the cells in the new puzzle plane with a side in the puzzle plane to be converted to the side of the new puzzle plane and determining a line type of each of the two sides relating to the line type information of each cell in the new puzzle plane as a line type of a side of the puzzle plane corresponding to the side of the new puzzle plane with reference to the puzzle plane information; and a step of generating puzzle plane information of the new puzzle plane by associating the position coordinates of each cell in the new puzzle plane with the generated line type information of the cell. The present invention is realized, for example, as a puzzle plane generation system of claim 1.

Effect of the Invention

As described above, the present invention can provide a puzzle plane generation system or the like for generating a puzzle plane constituted by a plurality of cells easily and in short time by storing, with respect to each of cells in a puzzle plane, puzzle plane information including position coordinates of the cell and line type information in which line types of two sides crossing at a predetermined apex are associated with each other, and having: a line type information generation unit for generating the line type information by associating each of two sides constituting the line type information of each of the cells in the new puzzle plane with a side in the pre-conversion puzzle plane and determining a line type of each of the two sides constituting the line type information of a cell in the new puzzle plane as the line type of the side of the puzzle plane associated with each of the two sides with reference to the puzzle plane information; and a puzzle plane information generation unit for generating puzzle plane information of the new puzzle plane by associating position coordinates of each cell in the new puzzle plane with the line type information of each cell generated by the line type information generation unit.

BRIEF DESCRIPTION OF DRAWINGS

FIG. 7 is a diagram showing conversion types provided by the puzzle plane generation system illustrated in FIG. 2.

FIG. 9 is a correspondence table showing correspondence relations between a reference cell and an adjacent reference cell in a puzzle plane and a process cell and an adjacent cell of a new puzzle plane with respect to predetermined geometric conversion.

FIG. 13A is a diagram of a cell correspondence table showing the correspondence relations between a reference cell and an adjacent reference cell in a puzzle plane and a process cell in a new puzzle plane in the case of 90-degree rotation in the first embodiment.

FIG. 13B is a diagram of a cell correspondence table showing the correspondence relations between a reference cell and an adjacent reference cell in a puzzle plane and a process cell in a new puzzle plane in the case of up-and-down inversion in the first embodiment.

FIG. 13C is a diagram of a cell correspondence table of line type patterns in the case of 90-degree rotation in the first embodiment.

FIG. 15B is a diagram showing data structure of a hint character area in the puzzle plane information illustrated in FIG. 14.

FIG. 15C is a diagram showing data structure of a correct-answer area in the puzzle plane information illustrated in FIG. 14.

BEST MODE FOR CARRYING OUT THE INVENTION

Figure 1:
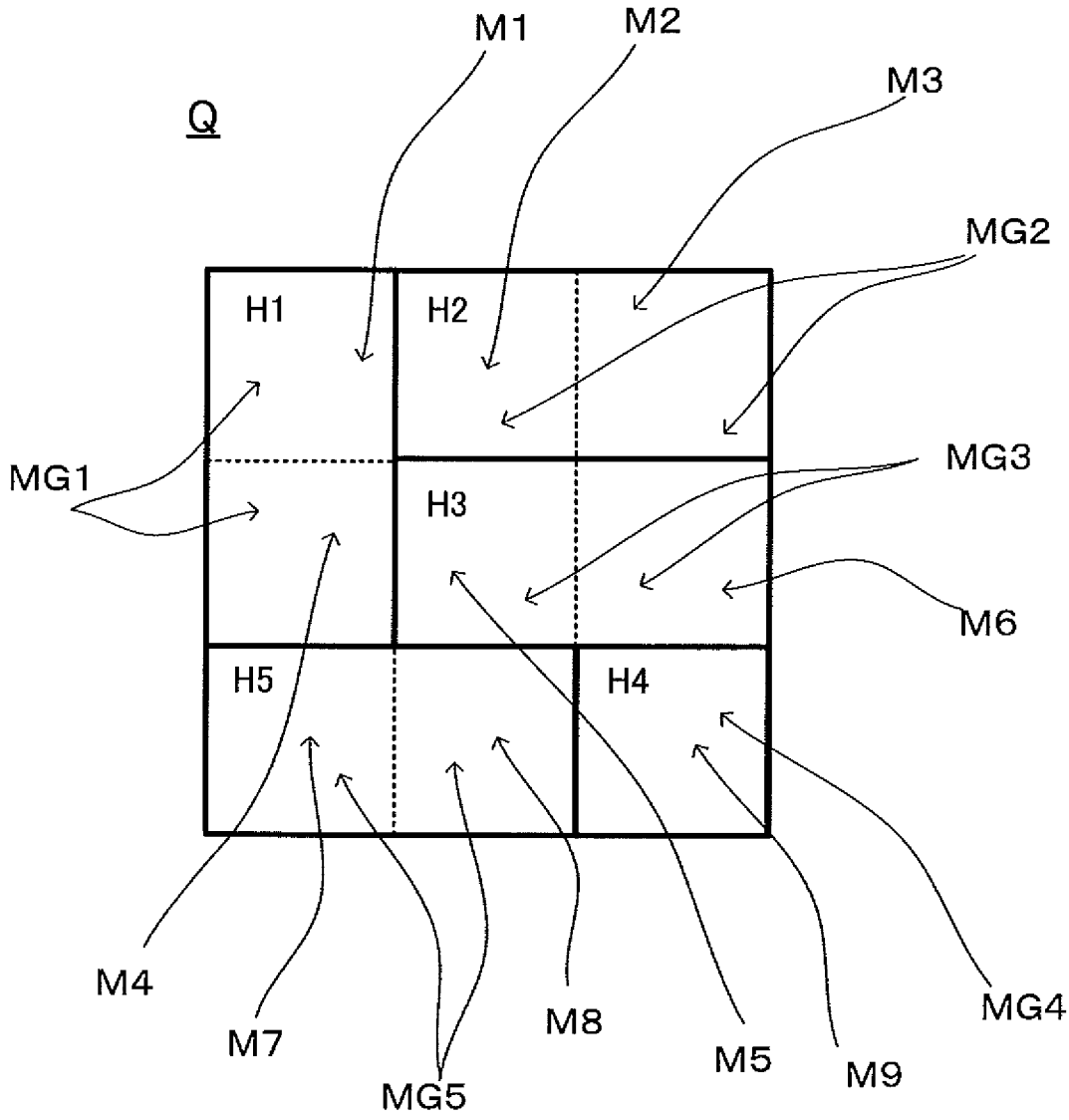
FIG. 1 is a diagram showing an example of a puzzle plane in the present invention.

First, a puzzle plane Q in a puzzle game of an embodiment will be described with reference to FIG. 1. The puzzle plane Q is constituted by arranging a plurality of square cells M1 to M9 in a matrix. When the cells M1 to M9 do not have to be distinguished from each other, they are called "the cell M". Although the cells are arranged in 3 rows and 3 columns in the embodiment, the number of cells arranged in each of row and column is not limited to three. In the puzzle plane Q, cell groups MG1 to MG5 are formed as five surrounded parts by grouping at least one cell M with a heavy line. Hint characters H1 to H5 are associated with the cell groups MG1 to MG5, respectively. Although characters are shown as the hint characters H1 to H5 in FIG. 5, actually, the hint character is represented as a combination of a numerical value and a symbol of operation such as 1+, 2+, 3+, . . . .

In what follows, when the cell groups MG1 to MG5 do not have to be distinguished from each other, they are called "the cell group MG". When the hint characters H1 to H5 do not have to be distinguished from each other, they are called "the hint character H". The outer frame of the puzzle plane Q and a side of cell M which is a part of the frame line of the cell group MG is represented by a heavy line as a first line type. Each of the other sides of the cells M is represented by a dotted line as a second line type. In the puzzle plane Q, the number of cell groups MG and the number of cells M included in one cell group MG are not limited to those of the mode shown in FIG. 1.

The puzzle plane Q is presented to a player by, for example, being displayed on a game screen of a predetermined game machine. A numerical value of 1 to 3 is input to each cell M. The numerical values have to be input so that the input numerical values do not overlap in each row/column and a total value in the cell group MG becomes a corresponding hint character H. The player moves an operation cursor to a cell M to be operated and inputs or eliminates a numerical value to/from the cell M on which the cursor exists. In such a manner, the player inputs numerical values in all of the cells M so as to satisfy the above-described conditions. The numerical value of the hint character H is set so that each numerical value input in each cell M is determined uniquely. Therefore, there is one correct answer per puzzle plane Q. When numerical values are input in all of the cells M by the player and they are correct, which means that the game is cleared.

Figure 2:
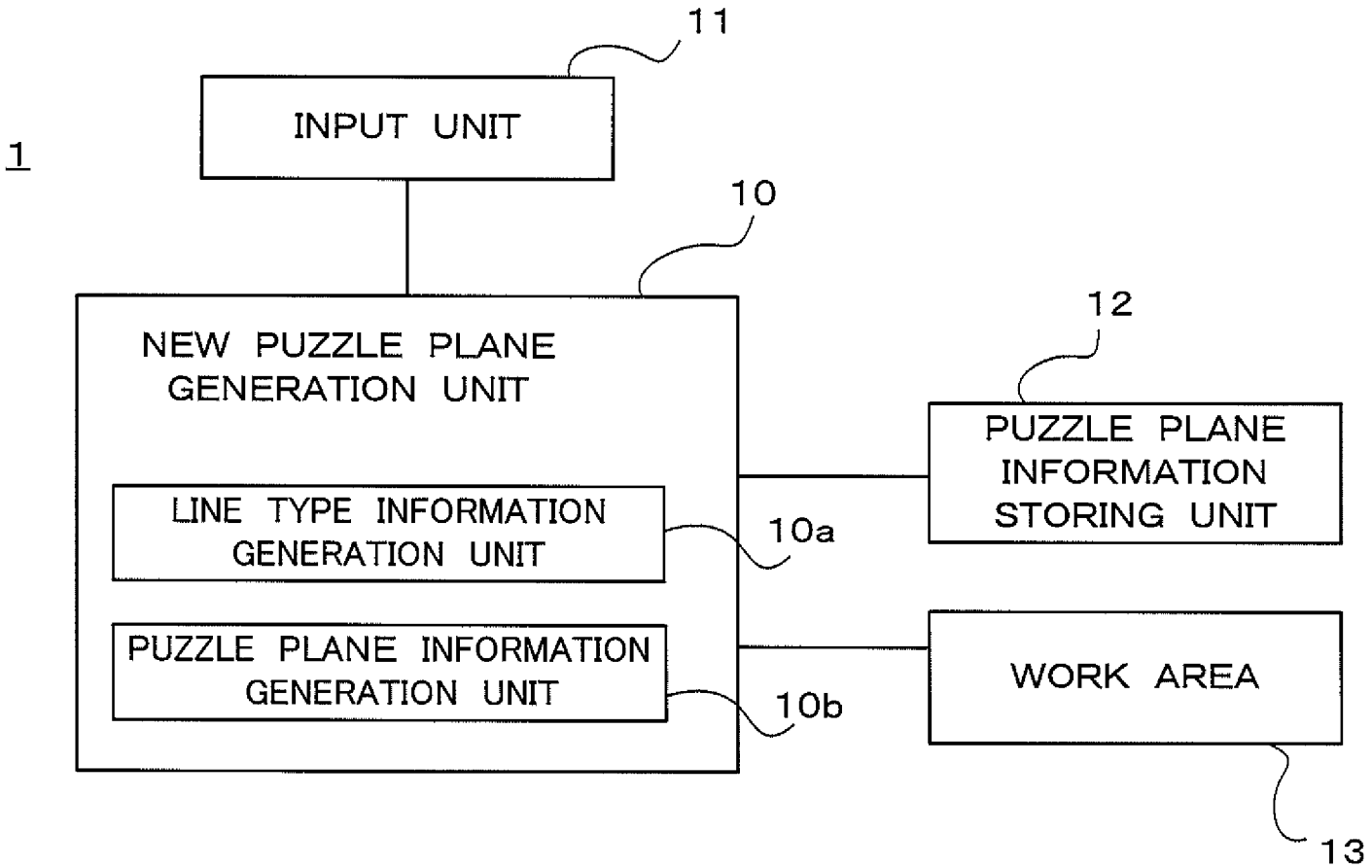
FIG. 2 is a schematic diagram of a hardware configuration of a puzzle plane generation system of the present invention.
Figure 3:
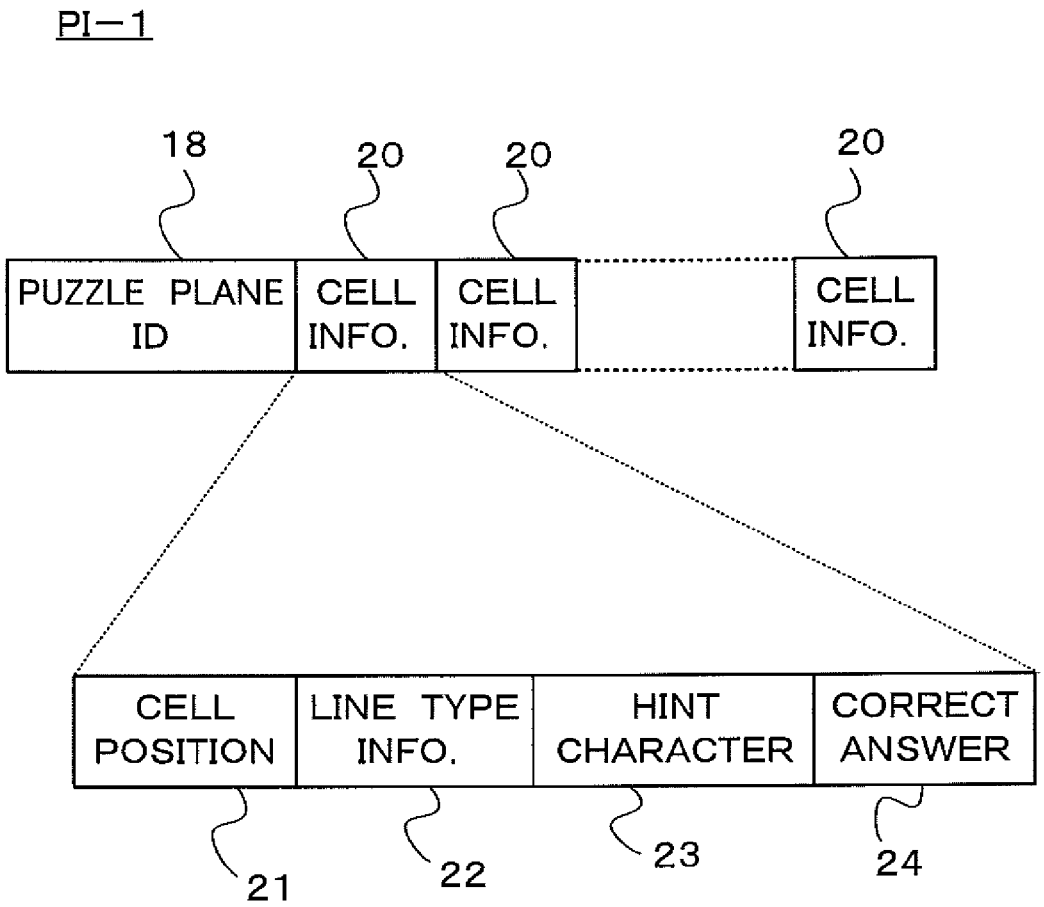
FIG. 3 is a diagram showing a data structure of puzzle plane information in a first embodiment.

Outline of the hardware configuration of a puzzle plane generation system 1 of the present invention will be described with reference to FIG. 2. The new puzzle plane generation system 1 is constituted by an input unit 11, a puzzle plane information storing unit 12, and a work area 13. The input unit 11 accepts input by a user for generating a new puzzle plane Q'. The puzzle plane information storing unit 12 stores puzzle plane information for determining the configuration of the existing puzzle plane Q. The data structure of the puzzle plane information will be described later. The work area 13 is a memory area used for generating the new puzzle plane Q'.

A new puzzle plane generation unit 10 is constituted mainly by a CPU and a storage area such as a RAM and a ROM necessary for the operation of the CPU, and controls operations of each unit 11 to 13. In the ROM, a computer program for realizing the present invention is stored. By starting the computer program, the new puzzle plane generation unit 10 mainly functions as a line type information generation unit 10*a* and a puzzle plane information generation unit 10*b*. The new puzzle plane generation system 1 may be also provided with a monitor in which predetermined information such as the new puzzle plane Q' is displayed.

Puzzle plane information PI-1 of the first embodiment for determining the configuration of the puzzle plane Q will be described with reference to FIGS. 3 to 6. The puzzle plane information PI-1 is constituted by a puzzle plane ID 18 for identifying a puzzle plane Q and cell information 20 set as information related to each of the cells M. In the case of the present embodiment, nine pieces of cell information 20 are associated with one puzzle plane information PI-1. The cell information 20 is constituted by a cell position 21 indicative of the position of the cell M, line type information 22, a hint character 23, and a correct answer 24.

Figure 4:
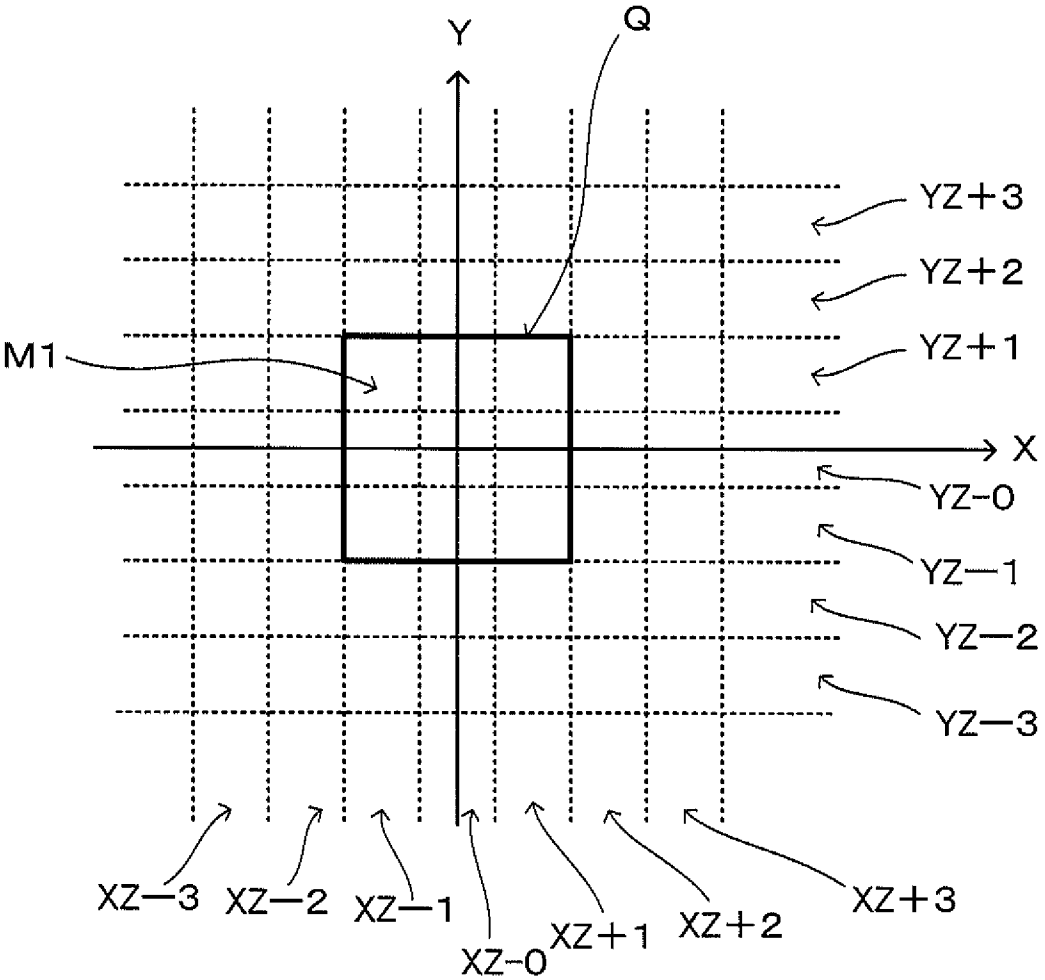
FIG. 4 is a diagram showing position coordinates applied to the case where a puzzle plane is made of odd-numbered cells×odd-numbered cells.
Figure 5:
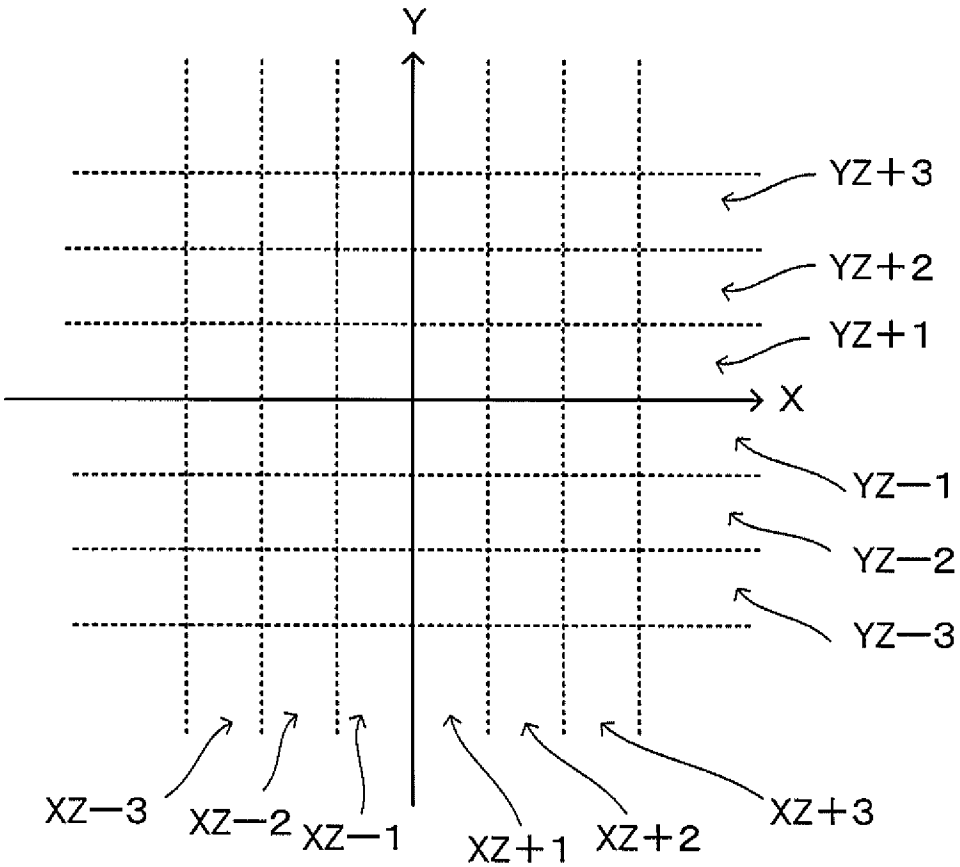
FIG. 5 is a diagram showing position coordinates applied to the case where a puzzle plane is made of even-numbered cells×even-numbered cells.
Figure 6:
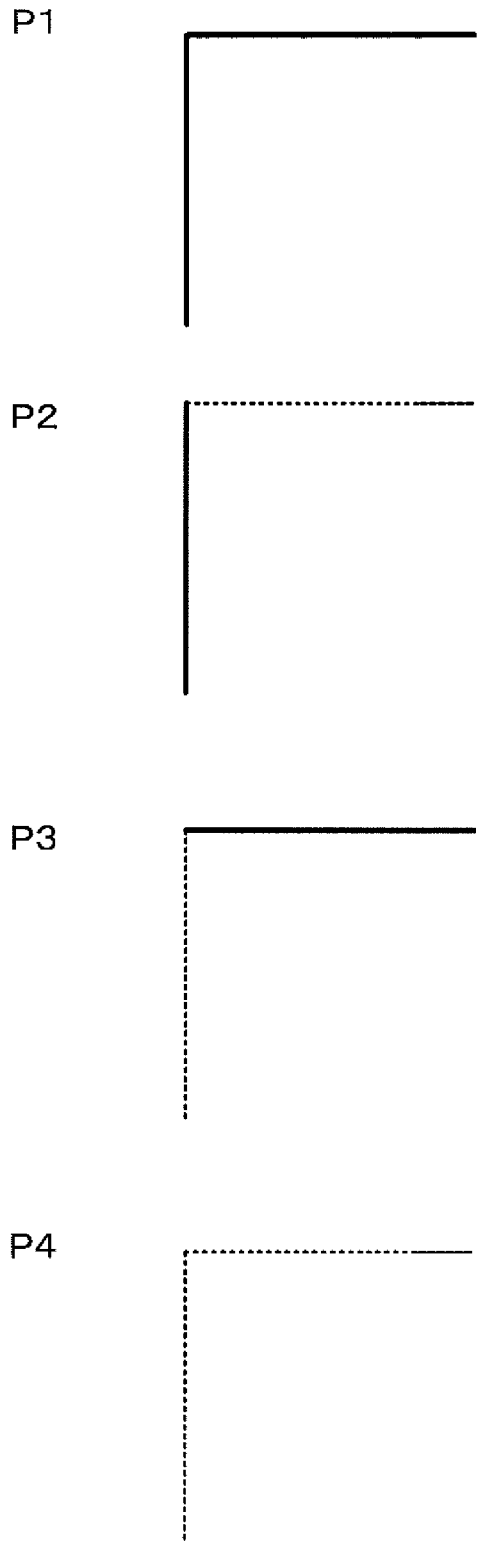
FIG. 6 is a diagram showing line type patterns of two sides.

The cell position 21 indicates the position coordinates of the cell M in a predetermined coordinate system. For position coordinates in the case where the puzzle plane Q has odd-numbered cells×odd-numbered cells, a coordinate system shown in FIG. 4 is used. For position coordinates in the case where the puzzle plane Q has even-numbered cells×even-numbered cells, a coordinate system shown in FIG. 5 is used. In each of the coordinate systems, a plurality of zones at equal intervals are set in each of the X-axis direction and the Y-axis direction. In FIGS. 4 and 5, common to both of the coordinate systems, an n zone in the X-axis direction is shown as XZ-n, and an n zone in the Y-axis direction is shown as YZ-n. Since a puzzle plane of 3×3 is used in the present embodiment, the coordinate system of FIG. 4 is used. For example, in the case of the cell M1, as the cell M1 is in the position of XZ--1 and YZ-+1, the position coordinates of the cell M1 are indicated as (−1, +1).

The line type information 22 indicates the line types of two sides crossing at the top left apex of each cell M, that is, the top side and the left side. As combinations of the line types with respect to the top side and the left side, as shown in FIG.

6, there are four line type patterns P1 to P4. In what follows, when the line type patterns P1 to P4 do not have to be distinguished from each other, they will be called "the line type patterns P". For example, in the case where the line type information 22 is represented as a form (line type of the left side, line type of the top side), a heavy line is referred to as "1", and a dotted line is referred to as "0", in the line type information 22, the line type pattern P1 is set as (1, 1), the line type pattern P2 is set as (1, 0), the line type pattern P3 is set as (0, 1), and the line type pattern P4 is set as (0, 0).

Figure 8:
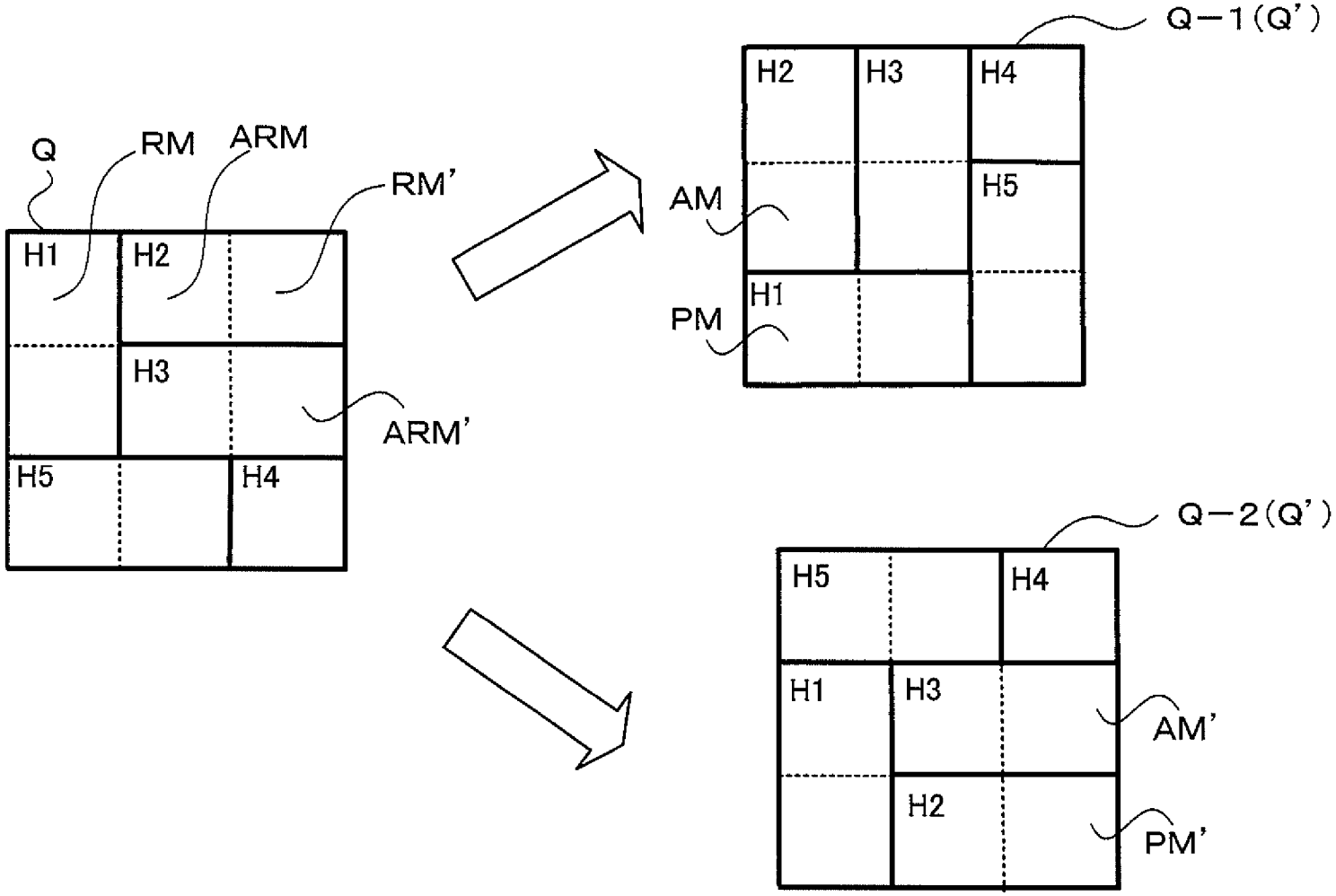
FIG. 8 is a diagram showing a state where a plurality of new puzzle planes are generated from a single puzzle plane.

Next, the principle of the method of generating the puzzle plane Q in the first embodiment will be described. The puzzle plane generation system 1 can generate maximum seven new puzzle planes Q' by combinations of basic geometric conversions based on the existing one puzzle plane Q. The basic geometric conversions in the present embodiment are 90-degree counterclockwise rotation (hereinafter, called "90-degree rotation") and up-and-down inversion. As the combinations of the basic geometric conversions, seven conversion types as shown in FIG. 7 are provided. FIG. 8 shows a new puzzle plane Q-1 generated from the existing puzzle plane Q by the conversion type "90-degree rotation" and a new puzzle plane Q-2 generated from the existing puzzle plane Q by the conversion type "up-and-down inversion".

In the case of the conversion type "90-degree rotation", procedure of obtaining the line type information 22 of each of the cells M of the new puzzle plane Q-1 from the line type information 22 of the puzzle plane Q will be described. In the case of setting to (X, Y) as the position coordinates, the line type information 22 of which is to be generated, of the cell M in the new puzzle plane Q-1 (hereinafter, called "the process cell PM"), the position coordinates of the cell M to be converted to the process cell PM (hereinafter, called "reference cell RM") are (Y, −X). In this case, the left side and the top side of the reference cell RM correspond to the bottom side and the left side of the process cell PM, respectively. Therefore, to obtain the line type of the top side of the process cell PM, the line type of the bottom side of an adjacent cell AM (X, Y+1) positioned right above the process cell PM is necessary. The position coordinates of the cell M to be converted to the adjacent cell AM (hereinafter, called an "adjacent reference cell ARM") are (Y+1, −X).

The left side and the top side in the line type information 22 of the adjacent reference cell ARM (Y+1, −X) correspond to the bottom side and the left side of the adjacent cell AM, respectively. Therefore, by obtaining the line types of the top side of the reference cell RM and the left side of the adjacent reference cell ARM with reference to the puzzle plane information PI-1 of the puzzle plane Q, the line type information 22 of the process cell PM is determined. Specifically, when the line type information 22 of the reference cell RM is (o, p) and the line type information 22 of the adjacent reference cell ARM is (q, r), the line type information 22 of the process cell PM is (p, q). For example, in the case of the process cell PM (−1, −1), according to the above-described coordinate converting procedure, the reference cell RM is (−1, +1), the adjacent cell AM is (−1, 0), and the adjacent reference cell ARM is (0, +1). As the line type information 22 of the reference cell RM is (1, 1) and the line type information 22 of the adjacent reference cell ARM is also (1, 1), the line type information 22 of the process cell PM is determined as (1, 1).

Next, in the case of the conversion type "up-and-down inversion", procedure of obtaining the line type information 22 of each of the cells M of the new puzzle plane Q-2 from the line type information 22 of the puzzle plane Q will be described. In the case of setting to (X, Y), the position coordinates of a process cell PM' in the new puzzle plane Q-2, the position coordinates of a reference cell RM' to be converted to the process cell PM' are (X, −Y). In this case, the left side and the top side of the reference cell RM' correspond to the left side and the bottom side of the process cell PM', respectively. Therefore, to obtain the line type of the top side of the process cell PM', the line type of the bottom side of an adjacent cell AM' (X, Y+1) positioned right above the process cell PM' is necessary. The position coordinates of the cell M to be converted to the adjacent cell AM' (hereinafter, called an "adjacent reference cell ARM'") are (X, −Y−1).

The left side and the top side in the line type information 22 of the adjacent reference cell ARM' (X, −Y−1) correspond to the left side and the bottom side of the adjacent cell AM', respectively. Therefore, the line type information 22 of the process cell PM' can be determined by obtaining the line types of the left side of the reference cell RM' and the top side of the adjacent reference cell ARM' with reference to the puzzle plane information PI-1 of the puzzle plane Q. Specifically, in the case where the line type information 22 of the reference cell RM' is (o, p) and the line type information 22 of the adjacent reference cell ARM' is (q, r), the line type information 22 of the process cell PM' is (o, r). For example, in the case of setting the position coordinates of the process cell PM' to (+1, −1), according to the above-described coordinate converting procedure, the reference cell RM' is (+1, +1), the adjacent cell AM' is (+1, 0), and the adjacent reference cell ARM' is (+1, 0). As the line type information 22 of the reference cell RM' is (0, 1) and the line type information 22 of the adjacent reference cell ARM' is also (0, 1), the line type information 22 of the process cell PM' is determined as (0, 1).

A correspondence relation table T shown in FIG. 9 illustrates the correspondence relations based on the above-described principle between the position coordinates of each of the cells M in the case where the position coordinates of the process cells PM and PM' are set to (X, Y), and the line type information 22 of the process cell PM in the case where the line type information 22 of the reference cells RM and RM' is set to (o, p) and the line type information 22 of the adjacent reference cells ARM and ARM' is set to (q, r). The correspondence relation table T is stored in a storage area in the new puzzle plane generation unit 10 and is properly referred to during process. The correspondence relation between the coordinate position and the line type in the other conversion types is obtained by combining the 90-degree rotation and/or the up-and-down inversion.

The hint character 23 is a hint character H in the cell group MG to which the cell M belongs. Although the hint character H is associated with each of the cells M, only the hint character H in one cell M positioned at the top left end in each cell group MG is displayed in the game screen during a game. For example, it is sufficient to put the last bit in the hint character 23 as a flag and set the flag of the hint character 23 of the cell M positioned at the top left end of the cell group MG. In the correct answer 24, a numerical value as a correct answer to be input in the cell M is set.

Figure 10:
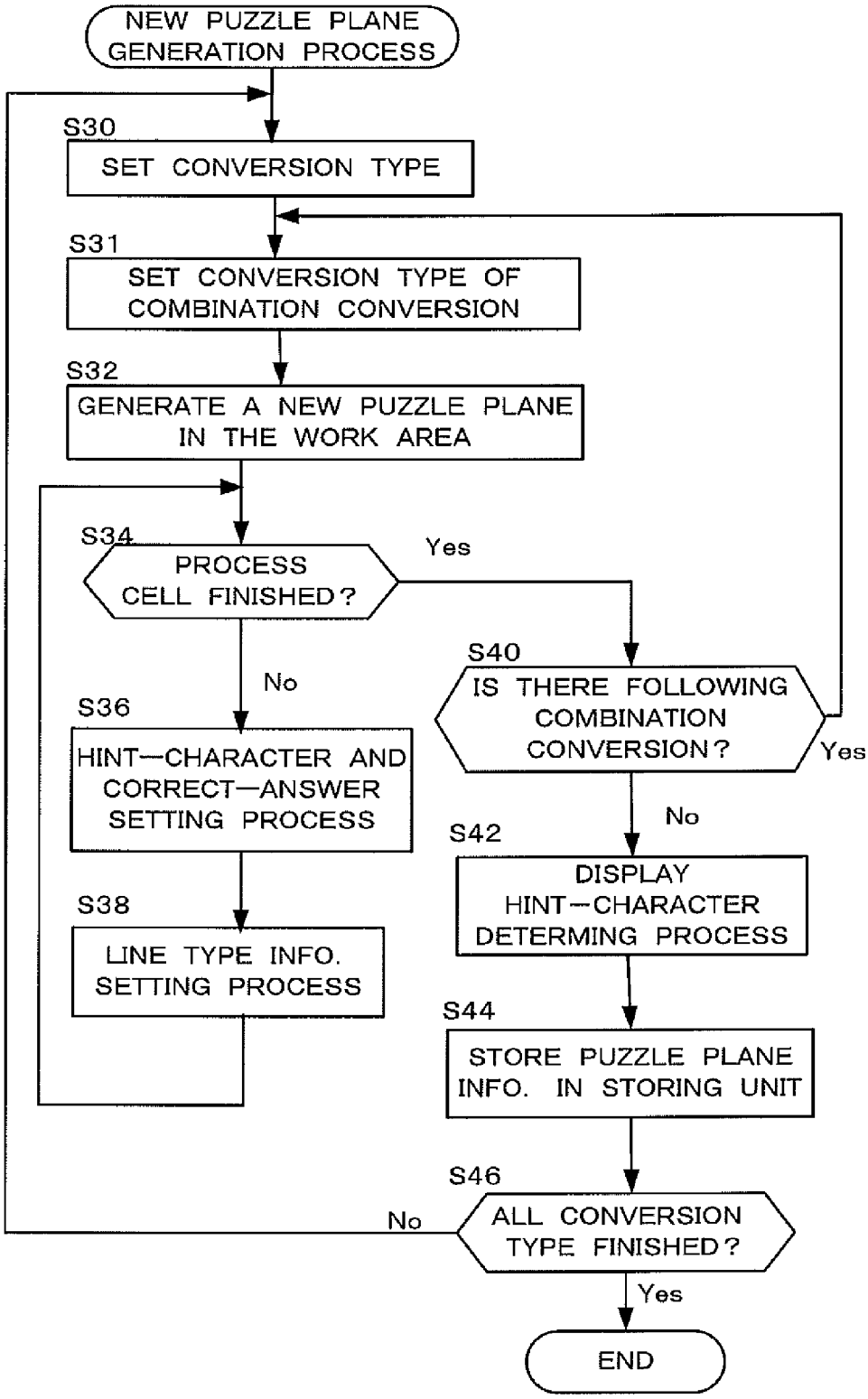
FIG. 10 is a flowchart showing a flow of processes in a new puzzle plane generation process of the first embodiment.

A new puzzle plane generation process for generating the new puzzle plane Q' from the puzzle plane Q will be described in accordance with a flowchart shown in FIG. 10. The new puzzle plane generation process is controlled by the new puzzle plane generation unit 10. First, the conversion type is set in Step S30. One of the above-described seven conversion types is set. In what follows, the case where 270-degree rotation is set as the conversion type will be described. Next, in Step S31, the conversion types of combination conversions are determined. The combination conversions are basic geometric conversions constituting the conversion type which is set in Step S30. In the case where the conversion type is 270-degree rotation, the combination conversions are 90-degree rotation of three times.

In Step S31, when there are a plurality of combination conversions, the conversion type of one of the combination conversions is determined. In the case where there is one combination conversion (for example, the conversion type set in Step S30 is a single basic geometric conversion), the conversion typeset in Step S30 is determined as the conversion type of the combination conversion. Next, in Step S32, a new puzzle plane Q' in which the puzzle plane information PI-1 is not set yet is generated in the work area 13. For example, the puzzle plane ID 18 of the new puzzle plane Q' is generated, and puzzle plane information PI' of the new puzzle plane Q' in which only the cell position 21 is set is generated in the work area 13.

Subsequently, in Step S34, it is determined whether all of the process cells PM to be processed in the new puzzle plane Q' finished or not. In the present embodiment, the process cell PM is specified one by one in the right direction from the cell M1 positioned at the top left end of the new puzzle plane Q'. When the following process cell PM cannot be specified, it is determined that the process cell PM to be processed does not exist, that is, all of the process cells PM finished. The processes executed on the process cell PM are the processes in Steps S36 and S38.

When the following process cell PM is specified, the processes in Steps S36 and S38 are executed on the specified process cell PM. The processes in Steps S36 and S38 are repeated on each of the cells M until the processes on all of the cells M finish. In Step S36, the hint-character and correct-answer setting process is executed. Thereby the hint character 23 and the correct answer 24 in the cell information 20 of the process cell PM are set. The details of the hint-character and correct-answer setting process will be described later. In Step S38, the line type information setting process is executed to set the line type information 22 in the cell information 20 of the process cell PM. The details of the line type information setting process will be described later.

In the case where it is determined in Step S34 that the processes on all of the cells M finished, the process advances to Step S40 where it is determined whether there is the following combination conversion or not. When there is a combination conversion left which is not processed, the process returns to Step S31, and the processes related to the following combination conversion are executed. When the processes on all of the combination conversions were executed, the process advances to Step S42. In Step S42, a display hint-character determining process is executed. In the display hint-character determining process, the flag of the hint characters 23 of the cells M, the line type pattern of which is P1, in the new puzzle plane Q' is set. When there are plural cells M the line type pattern of which is P1, the flag of the hint character 23 is set to the cell M positioned further left in priority to the other cells M. As a result, the hint character H is displayed in the cell M at the left end of each cell group MG.

After the process in Step S42, information to be set as each piece of the cell information 20 in the puzzle plane information PI' is set, that is, the puzzle plane information PI' is completed. It means that the new puzzle plane Q' is generated. In the following Step S44, the puzzle plane information PI' is stored in the puzzle plane information storing unit 12. Subsequently, the process advances to Step S46 and it is determined whether all of the processes finished on the seven conversion types or not. In the case where all of the puzzle plane information PI' corresponding to the conversion types were executed, the new puzzle plane generation process finishes. In the case where it is determined that there is one of the seven conversion types which is not yet executed, the process returns to Step S30.

Figure 11:
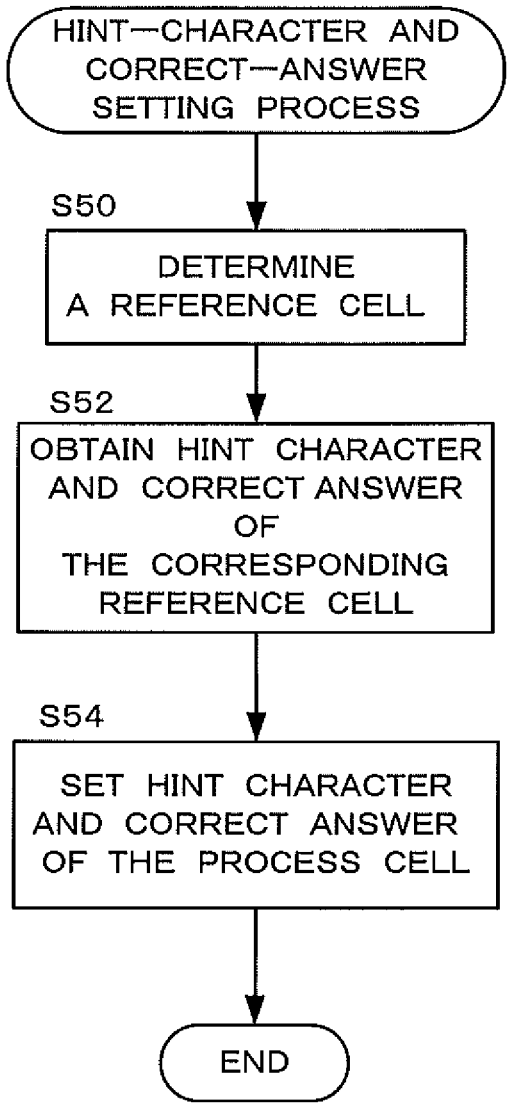
FIG. 11 is a flowchart showing a flow of processes in a hint-character and correct-answer setting process of the first embodiment.

The processes executed in the hint-character and correct-answer setting process will be described with reference to a flowchart shown in FIG. 11. First, in Step S50, with reference to the correspondence relation table T, the reference cell RM corresponding to the process cell PM is determined. In Step S52, by referring to the puzzle plane information PI-1 of the puzzle plane Q, the hint character 23 and the correct answer 24 in the cell information 20 of the reference cell RM are obtained. Subsequently, in Step S54, the hint character 23 and the correct answer 24 obtained are set as the hint character 23 and the correct answer 24 in the cell information 20' of the process cell PM. At this moment, all of the flags of the hint characters 23 are not set. After that, the hint-character and correct-answer setting process finishes.

Figure 12:
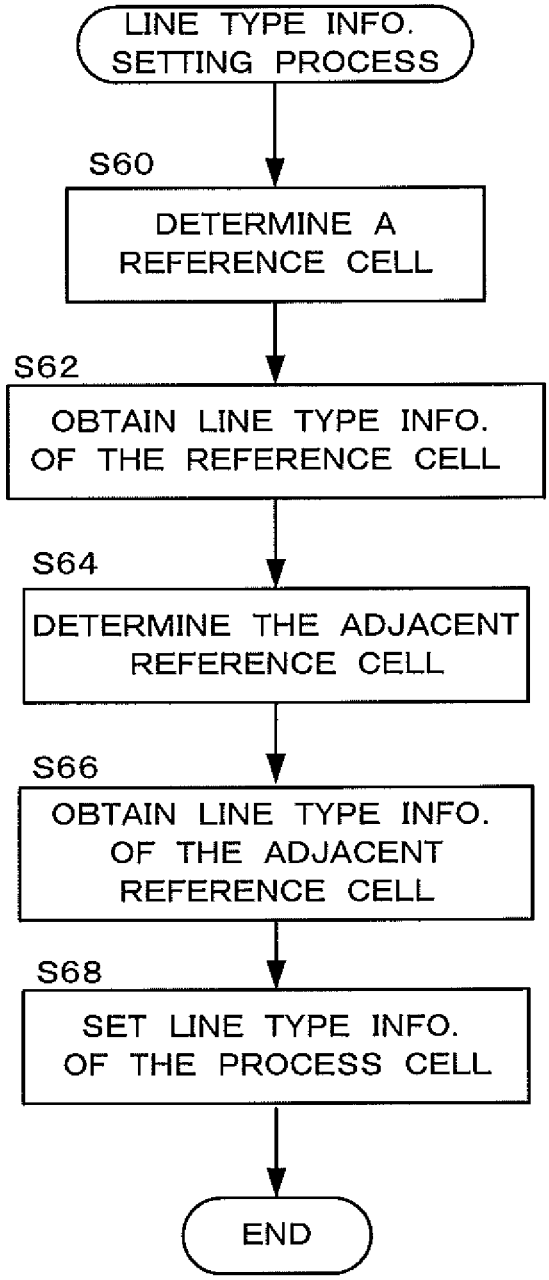
FIG. 12 is a flowchart showing a flow of processes in a line type information setting process of the first embodiment.

The line type information setting process will be described with reference to a flowchart shown in FIG. 12. Thereby, the new puzzle plane generation unit 10 functions as the line type information generation unit 10*a*. First, in Step S60, by referring to the correspondence relation table T, the reference cell RM corresponding to the process cell PM is determined. In Step S62, by referring to the puzzle plane information PI-1 of the puzzle plane Q, the line type information 22 of the reference cell RM is obtained. Next, in Step S64, by referring to the correspondence relation table T, the adjacent reference cell ARM corresponding to the process cell PM is determined. In Step S66, by referring to the puzzle plane information PI-1, the line type information 22 of the adjacent reference cell ARM is obtained.

For example, in the case where the position coordinates of the process cell PM are (0, +1), when the position coordinates of the adjacent reference cell ARM is obtained based on the correspondence relation table T, the position coordinates are specified as (+2, 0). As described above, in the case where a cell which does not exist on the puzzle plane Q is determined as the adjacent reference cell ARM, the line type information of the adjacent reference cell ARM is always set as the line type pattern P1 in Step S66 so that the line type of the outer frame of the puzzle plane Q is set as the line type of the adjacent cell AM.

Finally, in Step S68, by referring to the correspondence relation table T, the line type information 22 of the process cell PM is determined and set, based on the line type information 22 of the reference cell RM, that is, (o, p), and the line type information 22 of the adjacent reference cell ARM, that is, (q, r). As described above, in the case where the conversion type is 90-degree rotation, the line type information 22 of the process cell PM is set as (p, q). In the case where the conversion type is up-and-down inversion, the line type information 22 of the process cell PM is set as (o, r). The line type information generation unit 10*a* functions as a reference cell determining portion by Step S60, functions as an adjacent reference cell determining portions Step S64, and functions as an adjacent reference cell line type obtaining portion by Step S66. The line type information generation unit 10*a* functions as a process cell line type determining portion by Steps S62 and S68.

The first embodiment is not limited to the above-described embodiment but may be realized as various embodiments. The basic geometric conversions in the foregoing embodiment are 90-degree counterclockwise rotation or up-and-down inversion. 90-degree clockwise rotation or right-and-left inversion may be also employed. In the case of the 90-degree clockwise rotation and the up-and-down inversion, the adjacent reference cell ARM is right below the reference cell RM. That is, when the reference cell RM is (x, y), the adjacent reference cell ARM is (x, y−1). In the case of the 90-degree counterclockwise rotation and the right-and-left inversion, the adjacent reference cell ARM is on the right side of the reference cell RM. That is, when the reference cell RM is (x, y), the adjacent reference cell ARM is (x+1, y).

Although the position coordinates of the reference cell RM and the adjacent reference cell ARM are determined by calculation from the position coordinates of the process cell PM in the foregoing embodiment, it is also possible to prepare a cell correspondence table in which a cell M' of the new puzzle plane Q' and the cell M of the puzzle plane Q to be converted are associated with each other and determine the reference cell RM and the adjacent reference cell ARM to be referred to with reference to the correspondence table. FIG. 13A shows a cell correspondence table MT1 with respect to 90-degree counterclockwise rotation of the puzzle plane of 3×3. FIG. 13B shows a cell correspondence table MT2 with respect to up-and-down inversion of the puzzle plane of 3×3. In the case where there is no adjacent reference cell ARM, in a manner similar to the foregoing embodiment, it is sufficient to set the line type information of the adjacent reference cell ARM as the line type pattern P1. The cell correspondence tables MT1 and MT2 are stored, for example, in the storage area in the new puzzle plane generation unit 10.

Further, for example, in the case of the counterclockwise rotation, the top side of the reference cell RM is the left side of the process cell PM, and the left side of the adjacent reference cell ARM is the top side of the process cell PM. Therefore, in the case of setting the line type pattern P of the process cell PM from the line type pattern P of the reference cell RM and the line type pattern P of the adjacent reference cell ARM, the line type pattern P of the process cell PM to be set from the two line type patterns P is constant. By preparing and referring to a line type correspondence table in which the line type pattern P of the reference cell RM, the line type pattern P of the adjacent reference cell ARM, and the line type pattern P of the process cell PM are associated with each other based on such correspondence relations, the line type pattern P of the process cell PM may be determined. FIG. 13C shows a line type correspondence table MT3 of the line type pattern P in the counterclockwise rotation. The line type correspondence table MT3 is also stored in, for example, the storage area in the new puzzle plane generation unit 10.

Figure 14:
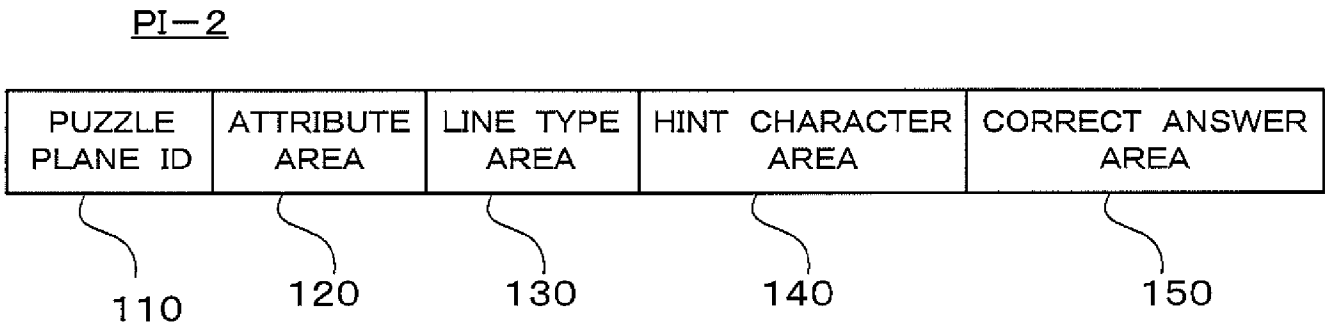
FIG. 14 is a diagram showing a data structure of puzzle plane information in the second embodiment.

A second embodiment will be described with respect to parts different from the first embodiment. The configuration of the puzzle plane Q and the hardware configuration of the new puzzle plane generation system 1 are the same as those of the second embodiment. Puzzle plane information PI-2 in the second embodiment is constituted by a string of successive ASCII characters as shown in FIG. 14. A puzzle plane ID 110 is information for identifying the puzzle plane Q, and an attribute area 120 is an area for setting the attribute of the puzzle plane Q, for example, the color of each cell Mat the time of displaying the puzzle plane Q on the game screen, the color of the background, the number of cells in the column direction and the number of cells in the row direction of the puzzle plane Q.

Figure 15A:
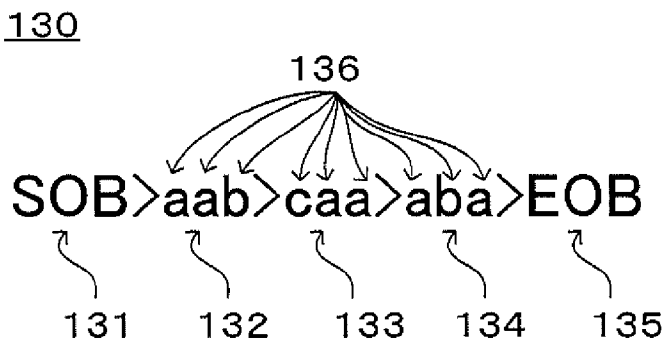
FIG. 15A is a diagram showing data structure of a line type area in the puzzle plane information illustrated in FIG. 14.
Figure 16:
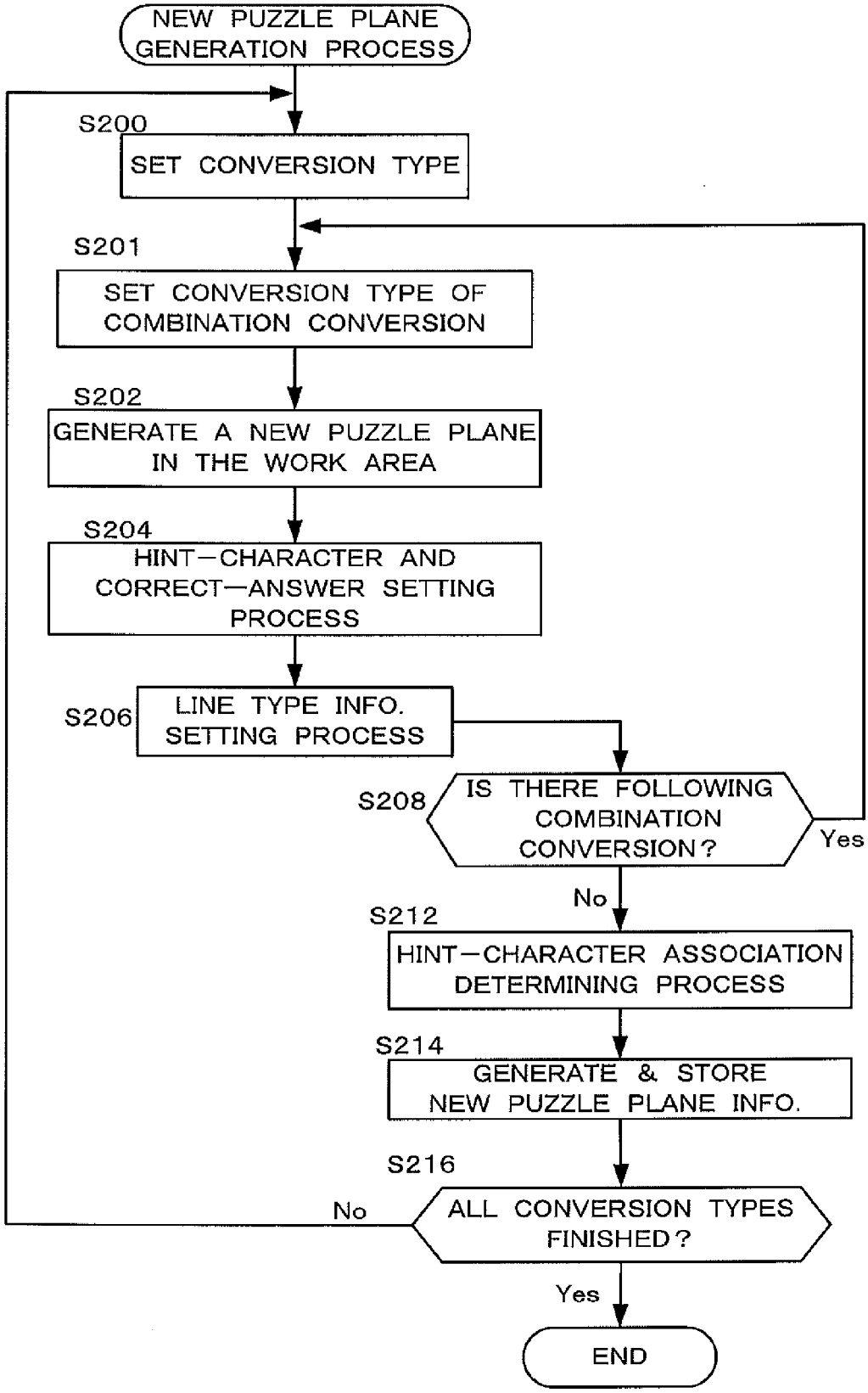
FIG. 16 is a flowchart showing a flow of processes in a new puzzle plane generation process in the second embodiment.

A line type area 130 is constituted by, as shown in FIG. 15A, start information 131, third-line information 132, second-line information 133, first-line information 134, and end information 135. The third-line information 132 indicates line type information 136 of the third line in the puzzle plane Q, that is, the cells M1 to M3. The second-line information 133 indicates the line type information 136 of the second line of the puzzle plane Q, that is, the cells M4 to M6. The first-line information 134 indicates the line type information 136 of the first line of the puzzle plane Q, that is, the cells M7 to M9. In the line type information 136 of the present embodiment, characters "a" to "d" are designated to the line type patterns P1 to P4, respectively. Therefore, each of the information 132 to 134 is shown by three characters. For example, since the line type patterns in the puzzle plane Q are P1, P1, and P3 from left, the third-line information 132 is set as "aac". The symbol ">" denotes a delimiter for readability of the character string set in the line type area 130.

The hint character area 140 is constituted by, as shown in FIG. 15B, start information 141, third-line information 142, second-line information 143, first-line information 144, and end information 145. The third-line information 142 indicates hint characters H of the third line in the puzzle plane Q, that is, the cells M1 to M3. The second-line information 143 indicates the hint characters H of the second line in the puzzle plane Q, that is, the cells M4 to M6. The first-line information 144 indicates the hint characters H of the first line in the puzzle plane Q, that is, the cells M7 to M9. In the present embodiment, the hint character is represented by two characters, so that each of the information 142 to 144 is made of six characters. For example, the hint characters H in the third line in the puzzle plane Q are H1, H2, and blank. Therefore, when H1=5+ and H2=3+, the third-line information 142 is set as "5+3+□□". In what follows, the hint character H includes also a blank. The symbol ">" denotes a delimiter for readability of the character string set in the hint character area 140.

The correct-answer area 150 is constituted by, as shown in FIG. 15C, start information 151, third-line information 152, second-line information 153, first-line information 154, and end information 155. The third-line information 152 indicates correct answers of the third line in the puzzle plane Q, that is, the cells M1 to M3. The second-line information 153 indicates correct answers of the second line in the puzzle plane Q, that is, the cells M4 to M6. The first-line information 154 indicates the correct answers of the first line in the puzzle plane Q, that is, the cells M7 to M9. In the present embodiment, one character as a correct answer is designated to each cell M. Therefore, each of the information 152 to 154 has three characters. For example, when the correct answers of the cells M1, M2, and M3 in the puzzle plane Q are "4", "3", and "1", respectively, the third-line information 152 is set as "431". The symbol ">" denotes a delimiter for readability of the character string set in the hint character area 140.

A method of generating a new puzzle plane Q' from the puzzle plane Q having the data structure as stated above will be described. In what follows, cells constituting the new puzzle plane Q' are represented by "the cells M'", and a cell group constituted by the cells M' is represented by "the cell group MG'". Also in the second embodiment, seven conversion types are provided by combining the basic geometric conversions. A new puzzle plane generation process executed by the new puzzle plane generation unit 10 of the second embodiment will be described. First, the conversion type is set in Step S200. For example, it is assumed that 270-degree rotation is set. Subsequently, in Step S201, the conversion types of combination conversions are determined.

The combination conversions are, as mentioned above, basic geometric conversions constituting the conversion type which is set in Step S200. In the case where the conversion type is set as 270-degree rotation, the combination conversions are 90-degree rotation of three times. In Step S201, one conversion type in a plurality of the combination conversions is determined. In the case where the conversion type set in Step S200 is a basic geometric conversion, the conversion type set in step S200 is determined as the conversion type of the combination conversion type.

Next, in Step S202, a new puzzle plane Q' is generated in the work area 13. For example, in a coordinate system where the right lower end of the puzzle plane Q is set as the origin, a new puzzle plane Q' is generated in a position where the puzzle plane Q is turned to the left by 90 degrees. The puzzle planes Q and Q' are represented as, for example, collections of apex coordinates of the cells M and M', respectively. Next, the process advances to Step S204 where a hint-character and correct-answer obtaining process is executed to associate the hint character H and the correct answer with each of the cells M' in the new puzzle plane Q' in the work area 13. The details of the hint-character and the correct-answer obtaining process will be described later. The process advances to step 206 where the line type information setting process is executed, and line type information 136' is associated with each of the cells M' in the new puzzle plane Q' in the work area 13. The details of the line type information setting process will be described later.

In Step S208, it is determined whether there is a following combination conversion which has not been processed or not. When there is a combination conversion on which the processes in Steps S202 to S206 have not been finished, it is determined there is the following combination conversion, and the process returns to Step S201 to execute the processes related to the following combination conversion. In the case where the processes have been finished on all of the combination conversions, it is determined that there is no combination conversion, and the process advances to Step S212 to execute a hint-character association determining process. By the hint-character association determining process, the hint character H is set so as to be displayed in the cell M' positioned at the top left end of the cell group MG'.

In the hint-character association determining process, in the case where the line type pattern of a cell M' (hereinafter, called "the hint cell M'") with which the hint character H other than blanks are associated is P1, the hint-character associating process finishes. In the case where the line type pattern is not the line type pattern P1, the following process is executed. In the case where the line type pattern of the hint cell M' is P2, the hint character H is associated with the cell M' which is positioned upper than the hint cell M' and whose line type pattern is P1. In the case where the line type pattern of the hint cell M' is P3 or P4, the hint character H is associated with the cell M' which is positioned leftward of the hint cell M' and whose line type pattern is P1. Blanks as a hint character H are associated with the hint cell M'. After the hint-character association determining process finishes, the hint character H, the correct answer, and the line type information 136' to be associated with each of the cells M' in the puzzle plane Q' are determined. Consequently, in Step S214, the line type area 130, the hint character area 140, and the correct answer area 150 of the new puzzle plane information PI-2' are generated from the information associated with each cell M' in the puzzle plane Q' and stored in the puzzle plane information storing unit 12.

After that, whether the processes have been executed on all of the seven conversion types or not is determined in Step S216. When it is determined that the processes on all of the seven conversion types have been executed, the new puzzle plane generation process finishes. When it is determined that the processes on all of the seven conversion types have not been executed yet, the process returns to Step S200 to set the next conversion type.

Figure 17:
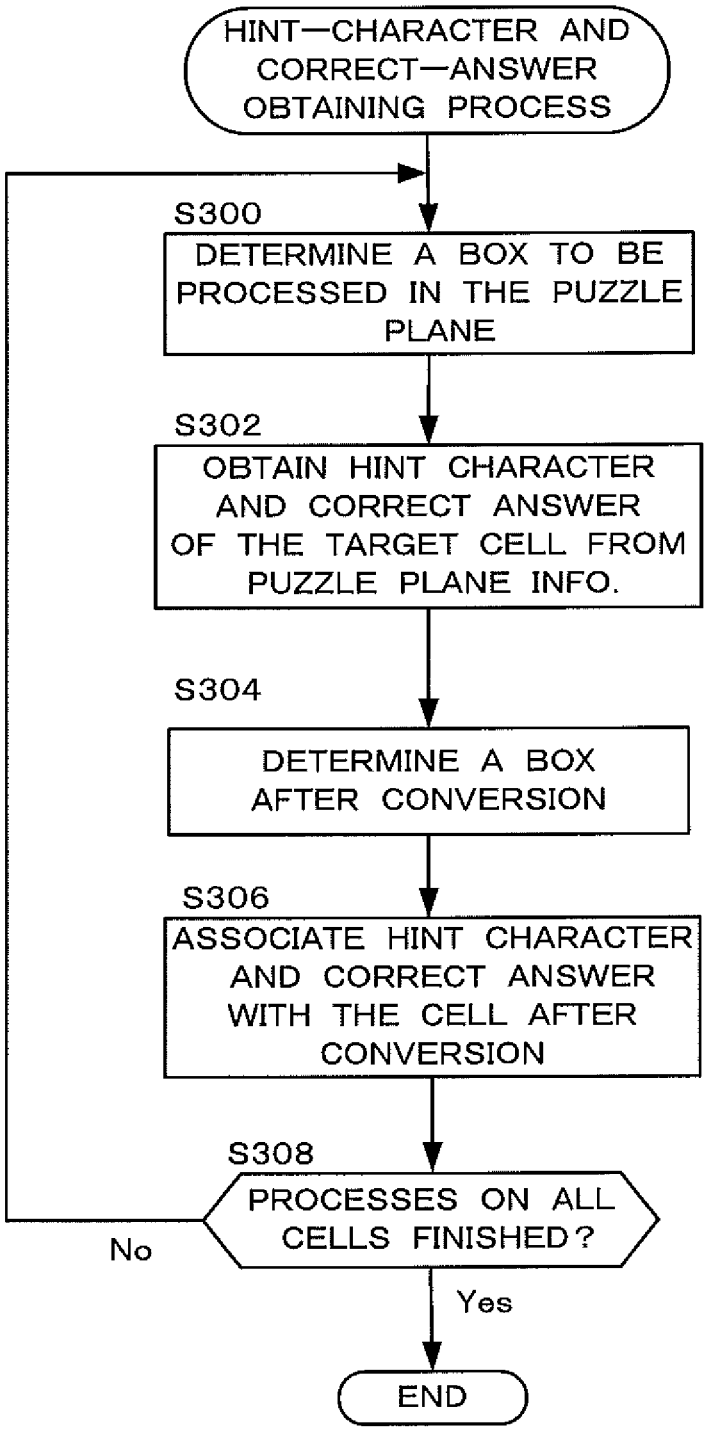
FIG. 17 is a flowchart showing a flow of processes in a hint-character and correct-answer obtaining process in the second embodiment.

The hint-character and correct-answer obtaining process will be described with reference to a flowchart of FIG. 17. First, in Step S300, a cell M to be processed (hereinafter, called "the target cell M") in the puzzle plane Q is determined. In the present embodiment, the target cell M is determined one by one in the right direction from the cell M1. Next, in Step S302, by referring to the puzzle plane information PI-2, the hint character H and the correct answer of the target cell M are obtained. In Step S304, a cell M' after conversion of the target cell M is determined.

In the following Step S306, the hint character H and the correct answer of the target cell M are associated with the cell M' after conversion. In Step S308, it is determined whether the processes in Steps S300 to S306 are executed on all of the cells M constituting the puzzle plane Q or not. When it is determined that the processes have been executed on all of the cells M, the hint-character and correct-answer obtaining process finishes. When it is determined that the processes have not been executed on all of the cells M, the process returns to Step S300 to execute the processes related to the next cell M.

Figure 18:
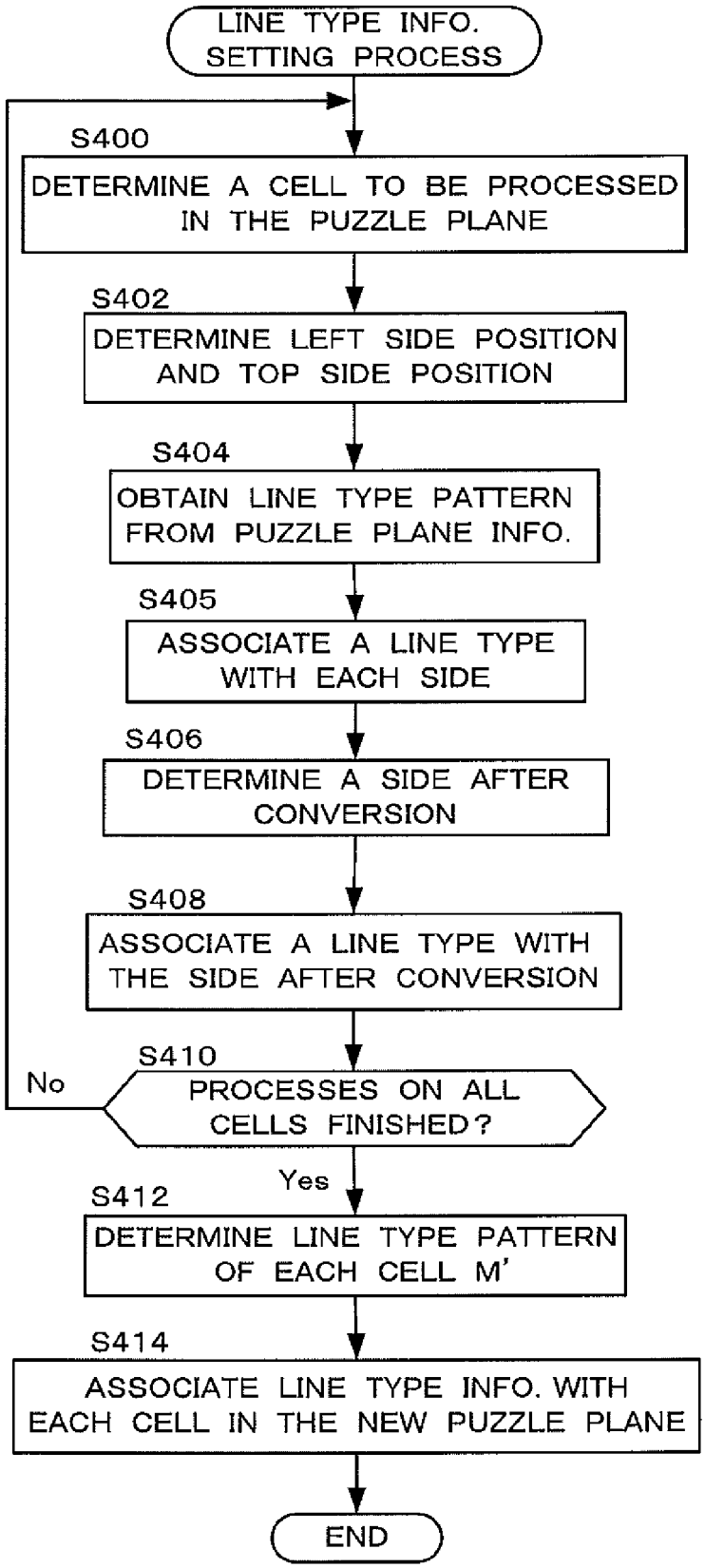
FIG. 18 is a flowchart showing a flow of processes in a line type pattern setting process.

The line type information setting process will be described with reference to a flowchart shown in FIG. 18. First, in Step S400, a target cell M in the puzzle plane Q is determined. In Step S402, the position of the left side and the position of the top side of the target cell M are determined. Subsequently, in Step S404, a line type pattern P is obtained from the line type information 136 of the target cell M in the puzzle plane information PI-2. In Step S405, a line type based on the line type pattern P is associated with each of the left side and the top side of the target cell M. Since the line types are set in order of the left side and the top side in the line type pattern P, it is sufficient to associate the line type of the left side in the line type pattern with the left side of the target cell M and associate the line type of the right side in the line type pattern with the top side of the target cell M. Next, in Step S406, the positions in the new puzzle plane Q' are determined, where the left side and the top side of the target cell M should be positioned after conversion.

For example, in a coordinate system where the left end of the puzzle plane Q is set as the origin, it is sufficient to put the new puzzle plane Q' at a position obtained by turning the puzzle plane Q by 90 degrees around the origin as a center and determine the sides of the new puzzle plane Q' corresponding to the sides of the puzzle plane Q. The determining method includes the case where the sides are specified by points or linear expressions and determined by calculation, and the case where the sides are determined by referring to a table in which the correspondence is pre-stored. When the sides after conversion are determined, the process advances to Step S408 to associate the line types of sides corresponding to the sides after conversion with the sides after conversion. In Step S410, it is determined whether the processes in Steps S404 to S408 finished on all of the cells M or not. When it is determined that the processes on all of the cells M finished, the process returns to Step S400.

When it is determined that the processes finished, the process advances to Step S412. In Step S412, the line types associated with the positions of sides corresponding to the left side and the top side of each of the cells M' in the new puzzle plane Q' are obtained, the line type pattern P of each of the cells M' is determined, and the line type information 136' corresponding to the determined line type pattern P is associated with each of the cells M' in the new puzzle plane Q' generated in the recording area 13 in Step S414. In the puzzle plane Q' after conversion, a line type is not associated with a side that is a part of the frame lines of the puzzle plane Q to be converted to the puzzle plane Q'. Therefore, the line type of a side with which the line type is not associated is always set to a "heavy line".

The present invention is not limited to the first and second embodiments but may be realized in various modes. For example, the method of calculating numerical values in each cell group MG may include not only addition but also subtraction. The hint character H is not limited to a positive number but may be a negative number. In the second embodiment, the puzzle plane Q may not be symmetrical vertically or horizontally. For example, the cell M may be a rectangular, and the arrangement of the cells M may be 1×5, 3×4, or the like. A conversion type for obtaining a new puzzle plane may be selected by the user.

The invention claimed is:

1. A puzzle plane generation system for generating a puzzle plane for a puzzle game in which a plurality of rectangular cells are presented, the rectangular cells being arranged in a matrix, a part of sides of the plurality of cells are represented by a first line type, and sides other than the part of sides are represented by a second line type, and a user is requested input to the plurality of cells so as to satisfy a predetermined condition according to a line type, the puzzle plane generation system comprising:

a storage unit for storing, with respect to each of the cells in the puzzle plane, puzzle plane information including position coordinates of each of the cells and line type information in which line types of two sides crossing at a predetermined apex of each cell are associated with each other; and a new puzzle plane generation unit for generating a new puzzle plane by geometrically converting the puzzle plane, wherein the new puzzle plane generation unit comprises:

a line type information generation unit for generating the line type information by associating two sides relating to the line type information of each of the cells in the new puzzle plane with sides in the puzzle plane that coincide with the two sides of the new puzzle plane by being geometrically converted respectively and determining a line type of each of the two sides relating to the line type information of each cell in the new puzzle plane as a line type of each side of the puzzle plane associated with each of the two sides of the new puzzle plane with reference to the puzzle plane information; and a puzzle plane information generation unit for generating puzzle plane information of the new puzzle plane by associating the position coordinates of each cell in the new puzzle plane with the line type information of the cell generated by the line type information generation unit.

2. The puzzle plane generation system according to claim 1, wherein the puzzle plane includes a surrounded part in which at least one cell is surrounded by the first line type, a side of each cell constituting the surrounded part is represented by the first line type, and a side of each cell which is not constituting the surrounded part is represented by the second line type.

3. The puzzle plane generation system according to claim 1, wherein an outer frame of the puzzle plane is represented by the first line type.

4. The puzzle plane generation system according to claim 1, wherein the cell has a square shape, a same number of cells are arranged in a vertical direction and a horizontal direction, and the puzzle plane is geometrically converted by any one of 90-degree clockwise rotation, 90-degree counterclockwise rotation, right-and-left inversion, or up-and-down inversion.

5. The new puzzle plane generation system according to claim 4, wherein the line type information generation unit comprises:

a reference cell determining portion for setting each cell in the new puzzle plane as a process cell in predetermined order, and determining as a reference cell, a cell in the puzzle plane to be converted to the process cell;

an adjacent reference cell determining portion for determining an adjacent cell sharing a side which is any one of the two sides relating to the line type information of the process cell, and does not correspond to the two sides relating to the line type information of the reference cell, and determining as an adjacent reference cell, a cell in the puzzle plane to be converted to the adjacent cell;

an adjacent reference cell line type obtaining portion for obtaining the line type information of the adjacent reference cell with reference to the puzzle plane information; an adjacent line type determining portion for determining the line type of a side corresponding to the sharing side in the adjacent cell, with reference to the obtained line type information; and a process cell line type determining portion for determining the line type information of the process cell by associating, to a side corresponding to any one of the two sides relating to the line type information of the reference cell out of the two sides relating to the line type information of the process cell, the line type of the corresponding side, and, associating to a side not corresponding to either of the two sides relating to the line type information of the reference cell, the line type determined by the adjacent line type determining portion, and the puzzle plane information generation unit generates the puzzle plane information of the new puzzle plane by associating the position coordinates of the process cell in the new puzzle plane with the line type information generated by the line type information generation unit.

6. A puzzle plane generation method for making a computer generate a puzzle plane for a puzzle game in which a plurality of rectangular cells are presented, the rectangular cells being arranged in a matrix, a part of sides of the plurality of cells are represented by a first line type, and other sides than the part of sides are represented by a second line type, and a user is requested input to the plurality of cells so as to satisfy a predetermined condition according to a line type, the computer having:

a storage unit for storing, with respect to each of the cells in the puzzle plane, puzzle plane information including position coordinates of each of the cells and line type information in which line types of two sides crossing at a predetermined apex are of each cell associated with each other; and a new puzzle plane generation unit for generating a new puzzle plane by geometrically converting the puzzle plane:

wherein the method comprises the step of generating with a processor, the new puzzle plane including: generating the line type information by associating two sides relating to the line type information of each of the cells in the new puzzle plane with a side in the puzzle plane that coincides with the two sides of the new puzzle plane by being geometrically converted respectively to be converted to the side of the new puzzle plane and determining a line type of each of the two sides relating to the line type information of each cell in the new puzzle plane as a line type of each side of the puzzle plane associated with each of the two sides of the new puzzle plane with reference to the puzzle plane information; and generating with the processor puzzle plane information of the new puzzle plane by associating the position coordinates of each cell in the new puzzle plane with the generated line type information of the cell.

* * * * *